United States Patent [19]

Swanson et al.

[11] 4,030,391

[45] June 21, 1977

[54] PUNCH PRESS WITH HYDRAULICALLY ACTUATED STRIPPER

[75] Inventors: James P. Swanson, Winnebago; Stephen E. Nyquist, Cherry Valley, both of Ill.

[73] Assignee: W. A. Whitney Corporation, Rockford, Ill.

[22] Filed: Nov. 3, 1975

[21] Appl. No.: 627,843

[52] U.S. Cl. ..... 83/137; 83/390; 83/461; 83/639

[51] Int. Cl.[2] ..... B26D 7/02; B26F 1/02

[58] Field of Search ..... 83/137, 390, 461, 590, 83/615, 617, 639; 100/218

[56] References Cited

UNITED STATES PATENTS

| | | | |
|---|---|---|---|
| 2,716,451 | 8/1955 | Taylor | 83/137 |
| 3,084,580 | 4/1963 | Schmid | 83/137 X |
| 3,564,959 | 2/1971 | Harada | 83/137 X |
| 3,722,337 | 3/1973 | Brolund et al. | 83/137 X |

*Primary Examiner*—Willie G. Abercrombie
*Attorney, Agent, or Firm*—Leydig, Voit, Osann, Mayer & Holt, Ltd.

[57] ABSTRACT

A punch press in which pressure fluid which is introduced into a chamber is used to press a stripper against a workpiece and also to retract a piston which carries a punch. The pressure of the pressure fluid in the chamber is maintained at a substantially constant but selectively adjustable magnitude.

5 Claims, 2 Drawing Figures

PUNCH PRESS WITH HYDRAULICALLY ACTUATED STRIPPER

BACKGROUND OF THE INVENTION

This invention relates generally to a punch press and, more particularly, to a punch press in which a punch is secured to and is movable with a piston and is advanced to form a hole in a workpiece in response to pressure fluid being admitted into one end of a cylinder which slidably receives the piston. Associated with and movable relative to the punch is a stripper which engages and clamps the workpiece as the punch first forms and then retracts from a hole. The stripper engages the workpiece just before the punch strikes the workpiece, and remains clamped against the workpiece until after the punch has been retracted from the hole. Thereafter, the stripper is released from the workpiece to enable the latter to be re-positioned relative to the punch.

In certain punch presses, the punch is hydraulically retracted and the stripper is hydraulically actuated. That is to say, pressurized oil or other liquid in the cylinder acts against the piston and the stripper for the purposes of (1) retracting the piston and the punch and (2) pressing the stripper into clamping engagement with the workpiece during retraction of the punch. Punch presses of this general type are disclosed in Taylor U.S. Pat. No. 2,716,451 and Brolund et al. U.S. Pat. No. 3,722,337. In the press disclosed in the Taylor patent, the pressurized liquid for retracting the piston and clamping the stripper is not alternately admitted into the cylinder from a pressure source and then dumped from the cylinder to drain but instead is maintained under substantially continuous pressure in a closed system which includes the cylinder. The continuously pressurized liquid thus forms a "hydraulic spring" which effects rapid return of the piston and secures clamping of the stripper.

SUMMARY OF THE INVENTION

The general aim of the present invention is to provide a punch press in which the stripper is actuated by a unique hydraulic spring which enables fast and easy selective adjustment of the clamping pressure exerted by the stripper and which, at the same time, enables the piston to advance through its punching stroke without encountering progressive resistance from the hydraulic spring during such stroke.

A related but more detailed object is to actuate the stripper with a hydraulic spring in which the pressurized liquid is maintained under substantially constant pressure at all times during the advance of the piston, the magnitude of the constant pressure being selectively adjustable to enable the stripper to clamp the workpiece with optimum force.

Another object is to provide comparatively simple means for pressurizing the liquid of the hydraulic spring and for maintaining the pressure at a substantially constant but selectively adjustable magnitude.

Still another object of the invention is to control the advance of the piston in a novel manner which decelerates the piston and cushions shock when the punch breaks through the workpiece.

The invention also resides in the unique interrelationship of the cylinder, the piston and the stripper.

These and other objects and advantages of the invention will become more apparent from the following detailed description when taken in conjunction with the accompanying drawings.

DETAILED DESCRIPTION OF THE PREFERRED EMBODIMENT

Figure 1:
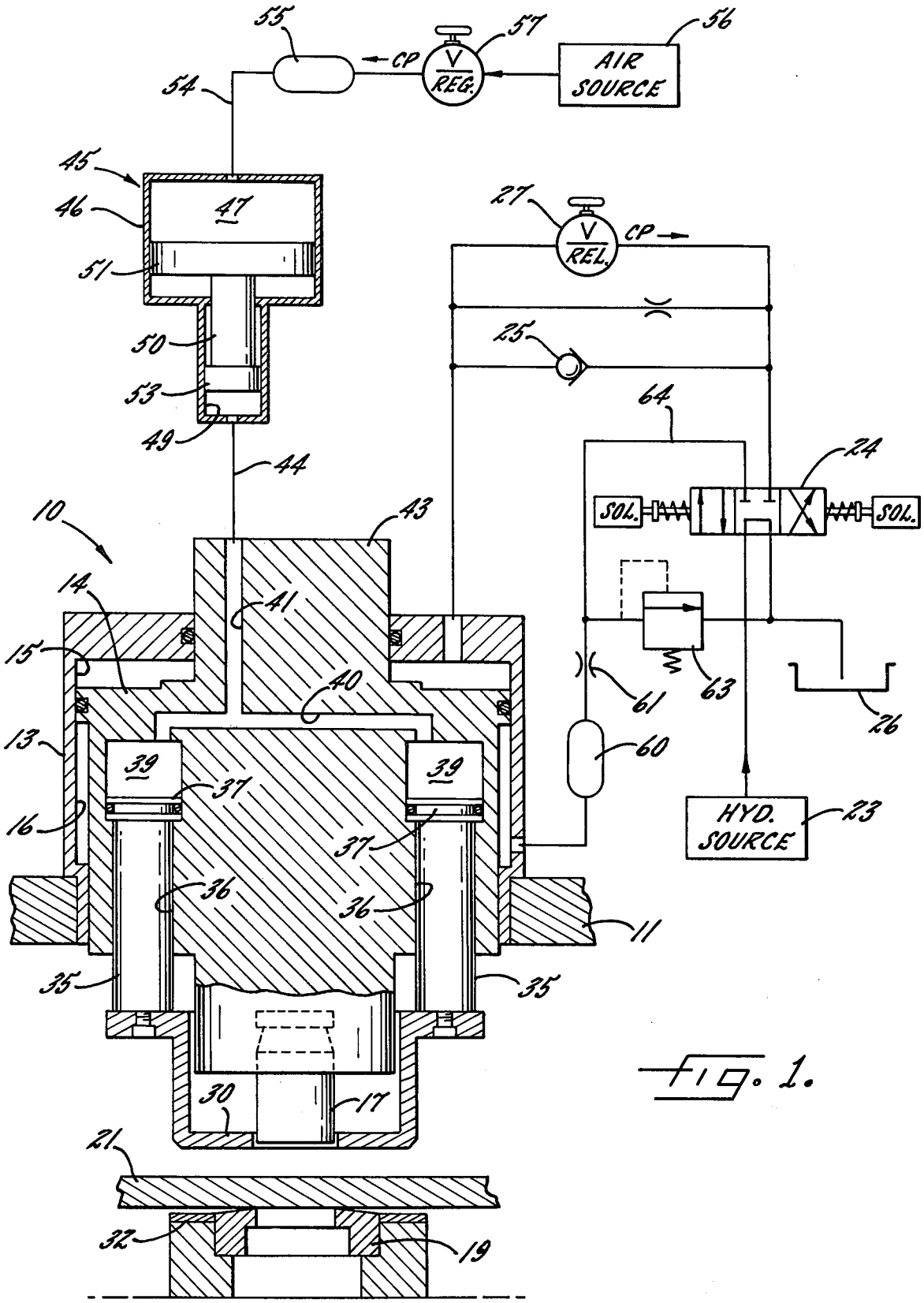
FIG. 1 is a view showing the piston, cylinder and stripper in cross-section prior to actuation of the piston and schematically showing part of a hydraulic circuit for controlling the piston and the stripper.

The invention is shown in the drawings as embodied in a punch press 10 which may be of the same general type as disclosed in Scott et al. U.S. Pat. No. 3,800,643. Since the principles of the invention may be incorporated in a press of known construction, the structural arrangement of the press itself has not been illustrated in detail. Instead, the drawings show only those features necessary to an understanding of the invention and such features have been illustrated in a schematic manner in order to simplify the disclosure.

In brief, the press 10 includes a support plate 11 which rigidly mounts an upright cylinder 13. A piston 14 is telescoped slidably in the cylinder and divides the latter into upper and lower compartments 15 and 16. Carried by and movable with the lower end of the piston is a punch 17 which is adapted to coact with an underlying die 19 to punch a hole in an intervening metal workpiece or sheet 21 when the piston is advanced downwardly in the cylinder. Such advance is effected by admitting pressure fluid at high pressure (e.g., up to 3,000 psi.) into the upper compartment of the cylinder. The pressure fluid is supplied to the upper compartment of the cylinder by a hydraulic pressure source 23 and is delivered through a four-way, three-position, solenoid-controlled reversing valve 24 and a check valve 25 when the reversing valve is shifted from its neutral position (FIG. 1) to its advance position (FIG. 2). When the reversing valve is shifted to its third position (not shown), the pressure fluid is released from the upper compartment of the cylinder and flows to a sump 26 by way of an adjustable pressure relief valve 27 which is connected in parallel with the check valve and in series with the reversing valve.

Associated with and movable relative to the punch 17 is a stripper plate 30 which clamps the work sheet 21 against an underlying stripper support or back-up 32 just before the punch strikes the sheet. The stripper 30 remains in clamping engagement with the work sheet as the punch first forms and then retracts from the hole in the sheet. As a result, the stripper performs two primary functions. First, pressure engagement of the stripper with the sheet 21 tends to coin the sheet upwardly around the die 19 and such coining counteracts downward distortion of the sheet caused by the punch moving through the sheet and into the die. Accordingly, the stripper helps keep the punched sheet flat in the area of the hole. Secondly, the stripper clamps the sheet rigidly against the stripper back-up 32 as the punch retracts from the hole and thus the stripper prevents the sheet from being lifted upwardly with the retracting punch.

In accordance with the primary aspect of the present invention, the stripper 30 is hydraulically actuated in a novel manner which enables the clamping pressure exerted by the stripper to be easily and selectively adjusted in accordance with the thickness and the metallurgical characteristics of the work sheet 21 being punched. Moreover, the same hydraulic force which presses the stripper against the work sheet is also used to retract the piston 14 upwardly when the pressure fluid is released from the upper compartment 15 of the cylinder 13. While the hydraulic force for actuating the stripper and returning the piston inherently resists downward movement of the piston during its advance stroke, the unique manner by which the force is applied to the stripper enables the resistance to be kept at a substantially constant value throughout the downward stroke of the piston and enables the resistance to be decreased in those instances where the workpiece is of the type which does not require high stripping pressure.

More specifically, the stripper 30 is supported on the lower ends of four upright and angularly spaced cylindrical rods 35 (only two of which are shown) which are slidably mounted in bores 36 formed in the piston 14. At their upper ends, the rods include enlarged heads 37 which are fitted within chambers 39 located at the upper ends of the bores. The chambers all communicate with one another by means of a radial passage 40 which is formed in the piston and which intersects an axial passage 41 leading out of an extension 43 on the upper end of the piston, the extension projecting slidably out of the top of the cylinder 13. A line 44 connects the passage 41 with a pressure amplifier or booster 45 for pressurizing the chambers 39.

Herein, the pressure booster 45 comprises a casing 46 having upper and lower chambers 47 and 49 which are sealed from one another by a plunger 50 extending between the chambers. A piston 51 with a comparatively large effective area is attached to the upper end of the plunger and is disposed in the upper chamber 47 while a piston 53 with an effective area approximately 1/30 that of the piston 51 is attached to the lower end of the plunger and is disposed within the lower chamber 49. The latter is connected to the passage 41 by the line 44.

The chambers 39, the passages 40 and 41, the line 44 and the chamber 49 define a closed hydraulic system which, during reciprocation of the piston 14, is continuously pressurized by oil or other suitable liquid contained in the system. To pressurize the system, air under pressure is admitted into the chamber 47 through a line 54 and acts against the piston 51 to force the plunger 50 downwardly and thus apply pressure to the oil in the chamber 49. The line 54 communicates with an air accumulating tank 55 which, in turn, communicates with a source 56 of pressurized air.

In keeping with the invention, a selectively adjustable constant pressure regulator 57 is interposed between the air source 56 and the tank 55 and acts to keep the air pressure in the chamber 47 at a substantially constant magnitude so that the oil pressure in the closed system including the chambers 39 will remain substantially constant regardless of the position of the heads 37 in the chambers. In this instance, the pressure regulator 57 may be adjusted to set the air pressure at any constant magnitude between 0 and approximately 80 psi. The differential pistons 51 and 53 provide a pressure amplification of about 30 to 1 and thus changing of the setting of the pressure regulator 57 enables the oil pressure in the chambers 39 to be varied between 0 and approximately 2400 psi., the oil pressure remaining substantially constant once the pressure regulator has been set.

With the foregoing arrangement, the pressure of the oil in the chambers 39 is selected in accordance with the nature of the work sheet 21 being punched. That is, the pressure regulator 57 is adjusted to set the oil pressure at a high magnitude if the work sheet requires substantial coining by the stripper 30 and at a lower magnitude if the stripper is required only to strip the work sheet from the punch 17. As will become apparent subsequently, it is desirable to set the oil pressure to only such a magnitude as is necessary to provide optimum coining and stripping of the work sheet by the stripper.

Figure 2:
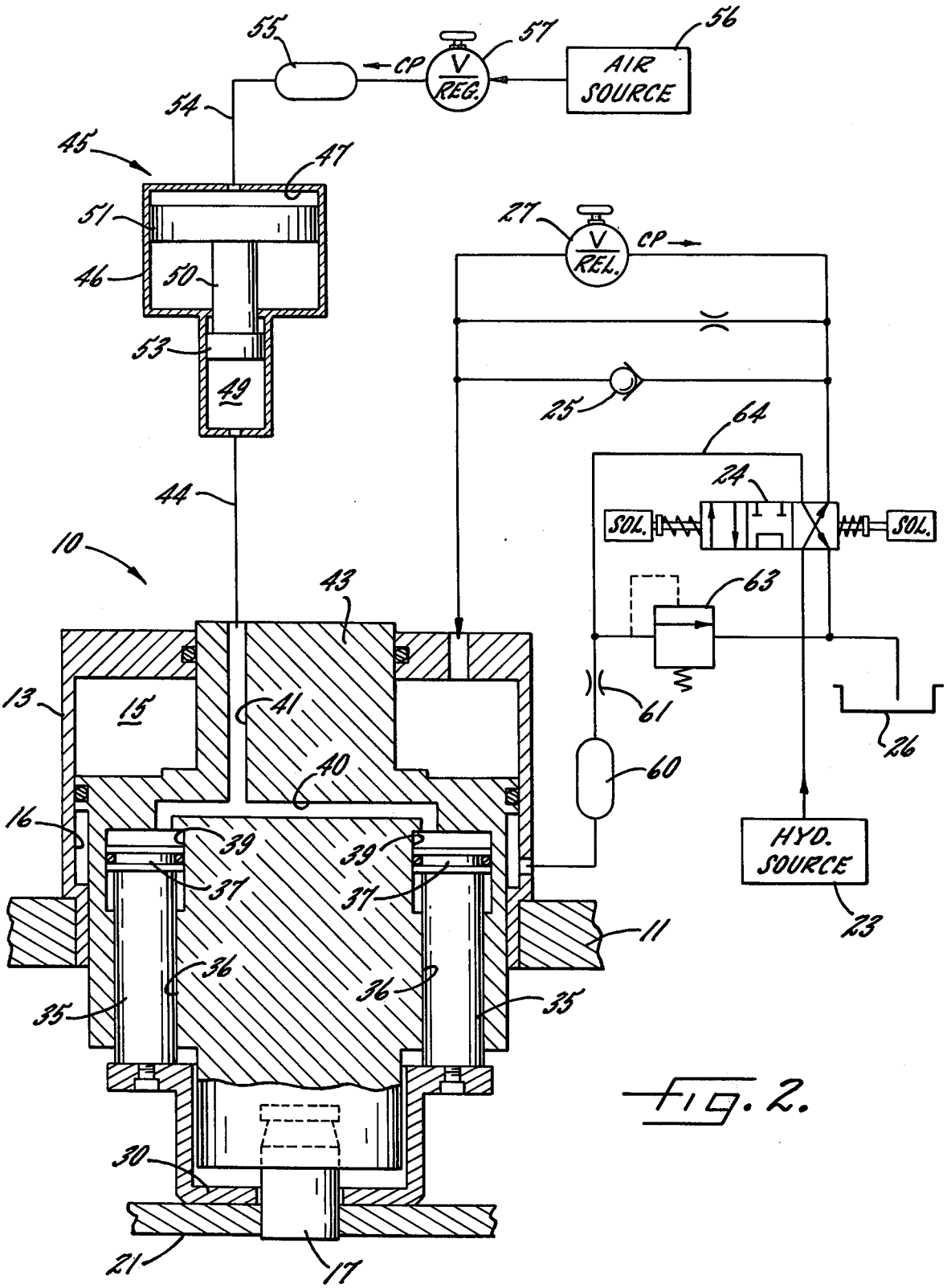
FIG. 2 is a view similar to FIG. 1 but shows the piston and the stripper after the punch has been forced through the workpiece.

With the chambers 39 pressurized and the piston 14 at the top of its stroke, the pressure in the chambers forces the heads 37 to bottom against the chambers 39 and biases the stripper 30 to a position extending below the lower end of the punch 17 as shown in FIG. 1. When pressure fluid is admitted into the upper compartment 15 of the cylinder 13 to advance the piston 14 downwardly, the substantially incompressible oil in the chambers 39 serves as a rigid medium between the heads 37 and the overlying portions of the piston and causes the stripper 30 to advance downwardly in unison with the piston.

Being located below the punch 17, the stripper 30 engages and clamps the work sheet 21 before the punch strikes the sheet and thus the stripper stops while the piston 14 continues downwardly to thrust the punch into the sheet. As soon as the stripper stops against the sheet, the heads 37 in effect move upwardly in the chambers 39 and reduce the volume of the chambers as the piston continues its downward movement and causes the punch to move downwardly beyond the stripper (see FIG. 2).

When the stripper 30 stops against the sheet 21 downward movement of the piston is resisted by the pressurized oil in the closed system which includes the chambers 39 since the oil in effect acts as a spring between the piston and the heads 37. The downward resistance remains substantially constant, however, at all times during downward movement of the piston relative to the stopped stripper and does not increase progressively as the piston proceeds further through its downward stroke and forces the punch 17 through the sheet. Such constant resistance results from the fact that the pressure regulator 57 and the booster 45 keep the oil in the chambers 39 under substantially constant pressure at all times during relative movement between the piston and the stripper and thus the oil pressure does not progressively increase and progressively retard movement of the piston as the latter moves downwardly.

After the punch 17 has broken through the work sheet 21, the reversing valve 24 is shifted to release the pressure fluid from the upper compartment 15 of the cylinder 13. As a result, the pressurized oil in the chambers 39 is free to cause the volume of each chamber to expand (compare FIGS. 1 and 2) and thus retracts the piston 14 upwardly while pressing the stripper 30 downwardly against the work sheet to keep the latter from being pulled upwardly from the die 19. Once the piston has been retracted through a certain distance, the bottoms of the chambers 39 engage the undersides of the heads 37 and cause the stripper to move upwardly in unison with the piston. The inertia of the piston causes the stripper to retract upwardly to the position shown in FIG. 1 so as to free the work sheet for re-positioning beneath the punch 17.

Accordingly, the present invention brings to the art a new and improved punch press 10 in which pressurized oil is used both to actuate a stripper 30 and to retract a piston 14. The press is particularly characterized by the fact that the pressure of the oil can be easily regulated to enable optimization between the desired degree of stripping force and the downward resistance encountered by the piston while keeping the resistance substantially constant as the punch 17 moves through the work sheet 21.

In accordance with another feature of the invention, means are provided for decelerating the piston 14 and cushioning shock when the punch 17 breaks through the work sheet 21. Herein, these means comprise an accumulator 60 whose one end communicates with the lower compartment 16 of the cylinder 13 and whose other end communicates with the sump 26 by way of a restricted orifice 61 and an adjustable pressure relief valve 63. In the actual construction of the press 10, the accumulator 60 may be an enlarged cavity at the lower end of the lower compartment 16 while the orifice 61 may be a drilled hole extending through the cylinder 13 and communicating with the lower compartment.

When the reversing valve 24 is shifted to retract the piston 14, oil flows into the accumulator 60 and the lower compartment 16 of the cylinder 13 by way of a line 64 which is in parallel with the relief valve 63. Such oil assists the oil in the chambers 39 in retracting the piston and, in addition, may be used to retract the piston beyond the position shown in FIG. 1 and to a more elevated tool change position which enables changing of the punch 17 and the die 19.

When the piston 14 is advanced downwardly, the oil in the lower compartment 16 flows out of that compartment to the sump 26. As the punch 17 breaks through the work sheet 21 and suddenly encounters virtually zero resistance, the oil flow from the lower compartment fills the accumulator 60 and is allowed to escape therefrom at a rate determined by the size of the orifice 61 and the setting of the relief valve 63. Accordingly, the oil in the accumulator 60 decelerates the downwardly advancing piston 14 and yet the oil is allowed to escape at a controlled rate from the lower compartment 16 of the cylinder 13 in order to prevent the oil pressure from reaching such a magnitude as to destroy seals within the cylinder or even the cylinder itself.

We claim:

1. A punch press comprising a cylinder, a piston telescoped slidably into said cylinder to move back and forth therein and dividing the cylinder into first and second compartments, a punching element secured rigidly to said piston and movable back and forth in unison with said piston whenever the latter is moved within said cylinder, means for selectively admitting pressure fluid into said first compartment of said cylinder to advance said piston within said cylinder and cause said punching element to form a hole in a workpiece, a stripper associated with said punching element and adapted to engage and hold said workpiece as said punch first forms and then retracts from said hole, said stripper being supported to slide in first and second directions relative to said piston and having one end coacting with said piston to form a chamber, a supply of pressurized liquid within said chamber and biasing said stripper in said first direction relative to said piston, said stripper moving in said second direction relative to said piston and reducing the volume of said chamber during advance of said piston after engagement of said stripper with said workpiece, said pressurized liquid expanding the volume of said chamber and retracting said piston after release of said pressure fluid from said first compartment of said cylinder, and means (a) for maintaining said liquid under substantially constant pressure at all times during movement of said stripper in said second direction relative to said piston and (b) for enabling selective adjustment of the magnitude of said constant pressure.

2. A punch press as defined in claim 1 in which said last-mentioned means include a selectively adjustable constant pressure regulator.

3. A punch press as defined in claim 1 further including a second chamber communicating with said one chamber, a plunger slidable within said second chamber and having a first effective area which acts upon said liquid to pressurize the latter, said plunger having a larger and oppositely facing effective area, and said last-mentioned means comprising (a) a source of pressure fluid acting on said larger effective area and (b) an adjustable constant pressure regulator for maintaining the pressure of said last-mentioned pressure fluid at a substantially constant but selectively adjustable magnitude.

4. A punch press as defined in claim 1 further including means for admitting pressure fluid other than said pressurized liquid into said second compartment of said cylinder when pressure fluid is released from said first compartment, the pressure fluid admitted into said second compartment assisting said pressurized liquid in retracting said piston.

5. A punch press as defined in claim 4 further including an accumulator communicating with said second compartment, the pressure fluid in said second compartment flowing through said accumulator when pressure fluid is admitted into said first compartment to advance said piston, and means for restricting the flow of pressure fluid out of said accumulator and away from said second compartment whereby the pressure fluid in said accumulator and said second compartment absorbs shock and causes said piston to decelerate when said punch breaks through said workpiece.

* * * * *